United States Patent [19]

Wootten

[11] 3,953,279

[45] Apr. 27, 1976

[54] APPARATUS FOR ASSEMBLING SPACED SHEETS TO FORM A PANEL STRUCTURE

[76] Inventor: William A. Wootten, 425 Via Corta, Malaga Cove Plaza, P.O. Box 98, Palos Verdes Estates, Calif. 90274

[22] Filed: Nov. 4, 1974

[21] Appl. No.: 521,005

Related U.S. Application Data

[62] Division of Ser. No. 170,120, Aug. 9, 1971, Pat. No. 3,846,218.

[52] U.S. Cl. ..... 156/513; 156/517

[51] Int. Cl.[2] ..... B32B 31/00

[58] Field of Search ..... 156/252, 253, 459, 510, 156/513, 517, 578; 93/1.1

[56] References Cited

UNITED STATES PATENTS

| | | | |
|---|---|---|---|
| 2,246,655 | 6/1941 | Bacon | 93/1.1 |
| 3,190,192 | 6/1965 | Neal | 93/1.1 |
| 3,517,589 | 6/1970 | Herd et al. | 93/1.1 |
| 3,741,079 | 6/1973 | Bossons et al. | 156/253 |

*Primary Examiner*—Douglas J. Drummond
*Attorney, Agent, or Firm*—Elliott I. Pollock

[57] ABSTRACT

An apparatus for joining a pair of sheets includes mechanisms for cutting patterns of plural partial perforations in the sheets, applying an adhesive material to at least one of the sheets, transporting the partially perforated sheets in spaced relation to one another with the pattern of partial perforations in each sheet being in opposed relation to the pattern of partial perforations in the other of said sheets, and bending the tab areas defined by the partial perforations in said sheets through an angle of substantially 90° to the plane of each sheet and in a direction extending toward the other sheet to cause corresponding pairs of said tabs to come into overlapping, planar engagement with one another in the region between said spaced sheets and to be bonded to one another by the adhesive material.

13 Claims, 28 Drawing Figures

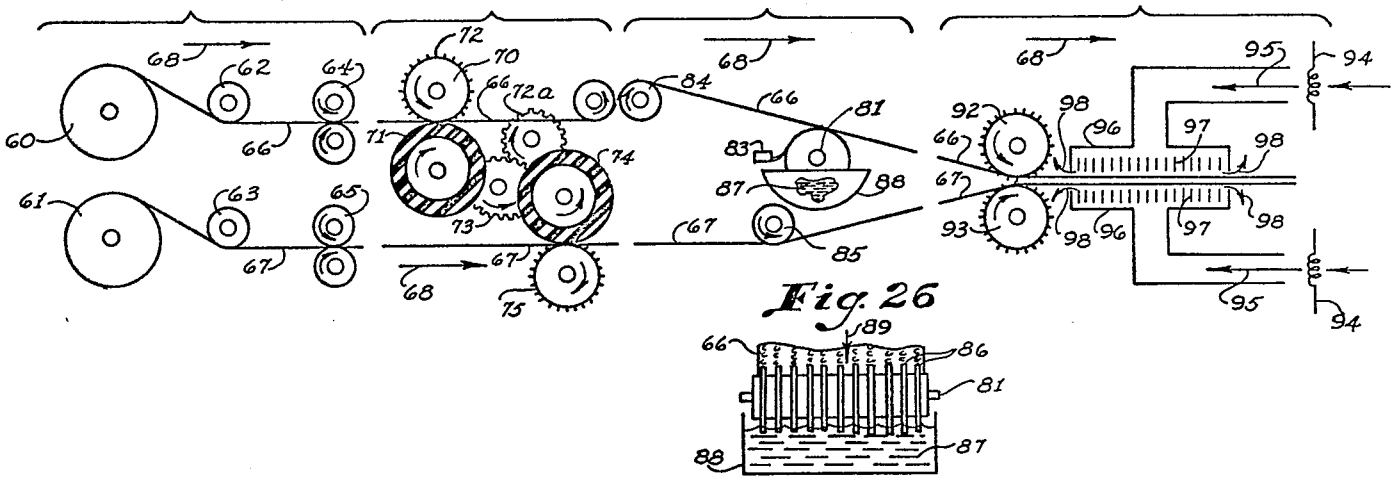
Fig. 23
Fig. 24
Fig. 25
Fig. 27
Fig. 26
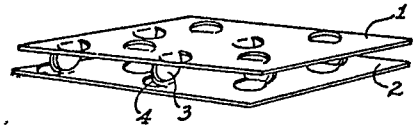
Fig. 28

APPARATUS FOR ASSEMBLING SPACED SHEETS TO FORM A PANEL STRUCTURE

CROSS REFERENCE OF RELATED APPLICATION

This is a division of my prior copending U.S. application Ser. No. 170,120 filed Aug. 9, 1971 now U.S. Pat. No. 3846218.

BACKGROUND OF THE INVENTION

The present invention relates to an apparatus for joining sheets or panels in the assembly and construction of a combination "expanded" construction for the make-up of packages and containers utilized for enclosing articles of commerce. The sheets or panels may be fabricated of fiber board, paper board, or other materials such as plastic or thin sheet metal. There is at present one generally accepted method for joining flat sheets of material in the production of a panel that is greater in dimension than the sheets employed in the make-up of the panel. This is referred to usually as "corrugated board stock" and is made of coarse fiber kraft material referred to in the trade as "liner board." Normally, the mechanical adjoinment of corrugated board is accomplished by the formation of an internal sheet in alternate involute forms or corrugations that are lateral to the make-up of the web or paper board sheets in assembly of such a combination. The product that results is a laminate of three or more board sheets consisting of a center corrugation joined by two flat sheets attached with adhesives to the apex of each corrugation. This material exhibits rigidity in one direction parallel to the course of the corrugation form and is flexible in a direction at right angles to these convolutions.

This invention teaches a method of achieving a mechanical interlock between two paper board panels through the adhesive attachement of extended latching elements, area tabs or partially perforated components which are bent at right angles to the planes of the perforated panels to afford an extension or intermediate linkage functioning to connect two such parallel panels or sheets to one another.

The production of the board of the present invention achieves a reduction in the amount of paper board or fiber board required in the manufacturing of an expanded board configuration and produces a board having rigidity in two directions and exhibiting tension and compression strength comparable to that of a prior art corrugated board consisting of three sheets. For purposes of full enclosure, the nature of the perforated configuration employed in each panel requires that an overlay sheet of light weight material be attached to the face of at least one such panel to dress or finish the external surface of a package. A similar overlay sheet can be applied to the opposite face of the board for dress or added strength.

In general usage, containers of the type produced with corrugated material fall into the category of shipping boxes and tertiary units that are employed for the utilitarian function of transportation.

Fiber board forms of corrugated material are regulated by certain rules that apply to shipments in interstate commerce. It is the intent and the purpose of this invention to make possible the strength and utility associated with conventional corrugated board, by utilizing materials with lighter basis weight and consisting of less fiber product than is the case presently with corrugated board stock.

It is an object of this invention to produce a paper board or fiber board product with a width dimension greater than the sum of thicknesses of the panels employed in the combination, by producing numerous extensions or tabs perforated from the panels and by attaching these tabs by adhesive means one to another.

It is a further object of this invention to employ in the production of a board with such an increased dimensional thickness, an area tab intermediary, partially perforated from the panels used and containing a secondary performation deployed within an opening in the tab of the opposite panel to achieve a mechanical linkage without requirement of adhesives.

It is a further object of this invention to produce a product that exhibits physical improvement in tension and compression over that exhibited by corrugated board and to accomplish this improvement by the specific displacement, in a varied angular arrangement, of partially perforated area tabs, and attaching said tabs to other tabs identically displaced from an opposite panel member.

It is a further object of this invention to provide a fiber board combination that consists of three sheets, one of which encloses one external perforated face of the product of this invention to provide an external finish to a container or box utilizing this medium.

It is an additional object of this invention to provide two panels of light weight sheet, fiber board material, to cover or enclose both sides of the perforated area of the product in this invention to achieve a finished packaging material.

It is another object of this invention to provide additional strength in this combination by the specific placement of the uncut portion of the perforation, thus making the tab join the coinciding tab element of the opposite sheet in a common plane but varying the angular placement of the tab planes from perforation to perforation.

It is a further object of this invention to provide an apparatus for the final closing or assembly of the board of the present invention which consists of means to compress the area tabs of the two panels together to accomplish a bonding function and, while under this pressure, is operative to move the pressure means in a counterrotational direction across the backs of the two tabs to distribute the adhesive disposed between their adjoined faces, thus improving the bonding of this intermediary linkage.

An additional object of this invention is the production of a paper board product of novel configuration in panels utilizing extremely heavy paper board materials in the order of 1/16th to 1/4 of an inch in thickness.

It is an additional object of this invention to provide improved procedures for the production of the novel paper board product of the present invention that involve web handling machinery and continuous procedures in the form of rotary equipment, cylinders and the like, making possible large volume manufacturing of the product, usually employing paper gauges ranging from 0.005 to 0.905 inches.

A further object of this invention is to provide a novel geometry in the enjoinment of paper and fiber board components to accommodate the necessary drying of adhesives by facilitating the passage of air through the plane of the board during the manufacturing process.

It is another object of this invention to produce a board configuration that permits the passage of air through its structure for the packing of items that require ventilation.

SUMMARY OF THE INVENTION

These and the objects of the present invention are achieved by converting two flat fiber or paper board panels into a combination flat board element with a dimensional thickness greater than the sum of the thickness of the two paper board planes employed.

The combination is formed by the adjoinment of tabs or extensions bent from the plane of the panels used. These tabs are provided by the partial perforation of the plane surface of the panels being joined. When bent from the plane of the panel, the tab portion of the perforated that is cut can be made to extend perpendicularly to the plane of the sheet, hinging on that portion that is uncut. Perforating is done at regular intervals or with a spacing that places the hinged portion of said perforations, or the uncut section of the perforation circle, in a variety of angular positions. The result of this cutting procedure is to provide tabs which, when deflected from the plane of the sheet, assume a variety of angles with respect to the longitudinal direction of the board being formed but with all tabs or extensions standing at 90° or perpendicular to the plane of the sheet.

The pattern or arrangement of perforations, and the bending of the tabs from the plane of the sheet, is planned so that a second sheet with similar perforations and tabs can be placed with the tabs of one sheet closely adjoining those of a second sheet or panel. The arrangement of this spacing is to place the tab of one panel back to back with that of the second. By the application of adhesives to the sheet following partial perforation, these extensions or tabs can be bonded, cemented or attached to one another so that a tight adjoinment exists to produce a linkage, or connection of an intermediary tab pair, between the two sheets.

Because of the angular displacement of the various perpendicular elements thus joined together, the two sheets are closely united by standing webs which are placed to produce conditions of maximum benefit in respect to structural arrangement. The doubling of the sheet or panel thickness in the joined tab or standing web portion of the structure together with such rigidity and cyrstallization properties as may exist in the adhesive employed for the purpose of bonding, gives additional strength to the overall structure.

The combining of these two flat paper panels, with the tabs extending at 90° to the planes of the panels, and with the arrangement of these tabs in the form of a rhombus or equilateral parallelogram, provides uniform strength characteristics in all directions.

Unlike the common corrugated board normally produced for the purpose of packaging, box manufacturing and article containment, this perforated board system provides a maximum strength and rigidity with a minimum amount of material. Unlike such corrugated forms, there is no third "medium" sheet that must be approximately 50% longer than that of the two "liner" sheets employed to retain the corrugated unit. Because of the additional strength imparted to this assembly by the particular geometry utilized, it is not necessary to use the paper weight usually associated with corrugated materials and a lighter paper board stock can be employed with resultant economies.

The combining of the perforated sheets can be accomplished by hand, particularly if thin materials are employed. Under these circumstances, a simple set of suitably sized pins or dowels are placed in a board or plate and arranged in sufficient quantity to be the equivalent of the number of perforations and in the same position with respect to the spacing of the perforated areas or panels being joined in the sheet. A similar dowel board can be used for the second sheet and the two units registered so that each pair of opposing dowel elements coincide in a side to side position as they deflect or bend the tabs inward, thus causing the wetted adhesive coated areas of these tabs to join forming a link or web. After a reasonable amount of time passes and the adhesive has set, the dowel boards can be opened. The sheets will be joined by the intermediary tab or extension at each point of perforation.

An accessory to this operation that is helpful is a section or frame unit disposed between the dowel boards to maintain a specific dimension with respect to thickness and eliminate the necessity for the dowel pins to "bottom out" on the surface of the sheet which, as noted earlier, is bearing an adhesive material. This eliminates the tendency of the tooling to adhere to the sheet and thus be troublesome.

The production of this type of hand-made panel is suitable only for very small applications, thin sheets of material and circumstances where tests and laboratory experiments may be desirable.

In circumstances where extremely heavy board is to be joined and individual panels are being prepared as units, it may be desirable to use one of two types of perforating means; the first being standard and expensive, male and female punch equipment and, the second, heavy duty die cutting steel bent to the partial cutting circle required and mounted in the conventional flat or rotary cutting unit. This type of perforating procedure would be applicable in very light board and even in board of moderate weight.

When using heavy weight materials, steel rule die cutting procedures may not be adequate and, under these circumstances, tooling in the form of male and female punch and die sets may be required to achieve the desired partial perforation associated with this system. Such die cutting procedures are well known and common to the art of cutting heavy stocks, although not usually applied in connection with paper board due to the costs. In this particular application, because of the partial perforation required, it is necessary to form the cutting face of the punch with an angular contour to permit penetration of the stock in a shearing action which limits the cut so that a section remains uncut to provide a hinge about which the partially perforated area or tab is later deflected.

In the preferred embodiment of this invention, the application of a punch in this form can be used with a tough resilient material, such as rubber or plastic, of, for example, 60 shore so that an effective punching or cutting is made in the sheet without completely passing through it. The rubber or plastic material constitutes a back-up for the punch and offers just enough resistance to provide a clean cut.

In the forming of heavy board stocks that probably would be handled in sheets, it is presumed that large tabs and comparatively heavy thicknesses of finished board is the objective. With thicknesses in the order of one to two inches and the sheet stock making up these units in the order of one quarter of an inch thickness, the partial perforation or tab cutting can be as large as an inch and a half in diameter. In a paper board sheet cut in this fashion, the resistance to bending is considerable and, after the application of the adhesive, it will be essential to use some form of hydraulic or compressed air actuated pin board or button board, probably made from a flat steel block with dowel pins inserted or a cast aluminum block with button forms on its face coinciding with a similar block, to provide the strength and pressure required for the deflection of the tabs and to retain them during adjoinment or until adhesives have been set by heat or other means.

The production of paper board panels in the form of this invention can also be accomplished by utilization of normal web handling machinery to deliver continuous webs into perforating machinery followed by glue or adhesive application equipment and assembly rolls providing the combining operation of this system.

It is standard procedure in the paper industry to employ large rolls of paper stock and equipment and procedures already exist for this purpose. Two such unwind stations deliver paper sheets in a continuous web to a perforating apparatus comprising cylinders with pins mounted on the periphery of said cylinders and ground with cutting face contours of the type (described earlier) to provide a pattern of partial perforations. The partial perforations required for the assembly of this combination are provided by closing the sheet being cut between the surface of this pin cylinder and that of a hard resilient coating or face on the second cylinder.

Two perforating cylinder pairs of this type produce the necessary partial perforations in two sheets at once. The dual cylinder assembly is synchronized by means of gearing common to the art.

A subsequent station can be used for the purpose of applying starch adhesives (as used in corrugated board) or other bonding materials of a variety of types.

Coating can be done by the use of reverse roll methods, curtain coating or by applying a pattern of adhesive by rotogravure cylinder means, synchronized with the perforation areas of the sheet being coated. After application of a full coat of adhesives, or adhesive striping, or even point to point spotting of adhesive, the sheets are ready for assembly.

While still tacky, the two partially perforated sheets are combined by extending their area tabs so that the adhesive coated faces thereof meet to achieve a suitable bond.

Two cylinders, their peripheral areas studded with pins, standing perpendicular to their axis are mounted on parallel journals with a spacing at their nip corresponding to that of the thickness of the finished board stock being produced. The pins are arranged to meet and pass one another so that the thickness of two sheets of paper board, or the thickness of the intermediary tabs, constitutes the space dimension between each pair of pins, this space representing the plane tangent to the pin peripheries. The pins sweep the surface of the tabs being joined in a counter direction, scissor-like action as the nip of the two cylinders close. Thus placed, the pins function to (1) register the sheet; (2) bend the area tabs away from the plane of the sheet; (3) retain each tab in a perpendicular position as it is adjoined with its opposite member bent from the plane of the second sheet; (4) distribute adhesive between the adjoined tab faces by counter directional motion and (5) transfer heat to the tab by contact during the dwell time of pin engagement.

Pin placement around the cylinder periphery can be varied to conform with the pattern variation used during the earlier perforation procedure.

Experimentation has shown that the most rigid structure is accomplished by division of the area tab links or intermediary elements into four angular planes, disposed respectively at 45° and 90°, to the left and right of the longitudinal direction of the web, thus forming a rhombus or equilateral box-like elements of four tabs each. Pins are placed around the periphery of the cylinder in a helix pattern at a 45° angle relative to the axis of the cylinders, for this pattern. The pins of the second cylinder are placed along a helix extending in the opposite direction, and also exhibiting a 45° angle to the axis. Two pin sets meet at the tangent point closing around the tabs to maintain their positioning in a 45° planar relationship with respect to the longitudinal direction of the web of the board being formed.

The pin cylinders are heated to approximately 350°F using steam passed through rotary seals or applied by other means, resistance coils, hot oil systems and the like. Perforated and adhesive coated webs introduced to these rolls are effectively drawn into their nip as the pins enter the sheet perforations. Gear synchronization between the cylinders is essential. As the sheets are engaged, the pins gradually enter the perforations, deflecting the tabs inward. As each pair of pins close in proximity to one another, two tabs of the two sheets are brought in conjunction. The movement of the cylinders and the passage of the pins produce a counter-motion inscribing a part of an arc across the back faces of the tabs, giving a dwell time for heat transfer by conduction and convection.

After the joined sheets leave the combining apparatus described above, the sheet structure may be subjected to conventional hot air convection, air impingement or such other radiating heat means as may be desirable; e.g., of the type utilized in the conventional production of corrugated paper, for the purpose of effecting controlled drying of the board to drive residual moisture distributed into the sheet from the point of adhesion. The equipment and apparatus which can be used for this purpose are standard and common to the art of paper-making.

BRIEF DESCRIPTION OF THE DRAWINGS

FIG. 23 illustrates a portion of an apparatus used to manufacture the product of the present invention, comprising two unwind stations and two draw rolls.

FIG. 24 illustrates a further portion of an apparatus used to manufacture the product of the present invention, comprising a perforating mechanism for partial perforation of two sheets or webs simultaneously.

FIG. 25 illustrates an additional portion of the fabricating apparatus, comprising a bead applicator applying adhesive stripes to a single web while the second web passes adjacent to the adhesive coated sheet.

FIG. 26 illustrates the bead applicator discs of FIG. 25 immersed in fluid, and the relationship of the discs to the perforations of the web.

FIG. 27 illustrates a still further portion of the fabricating apparatus, comprising guide rolls, a pin closing mechanism, and an impingement drying system; and FIG. 28 is a perspective illustration of the paper board composite of this invention.

DESCRIPTION OF THE PREFERRED EMBODIMENTS

Figure 1:
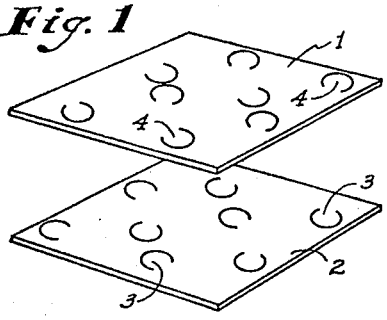
FIG. 1 is a perspective and separated view of the preferred embodiment, and illustrates the two components of the paper board product of the present intvention.

Referring now to the drawing, FIG. 1 illustrates the basic paper board or fiber board panel components 1 and 2 of the present invention, the panels being perforated respectively at 3 and 4 with corresponding partial perforations. As illustrated, a portion of each perforation is left uncut to produce a hinge line about which a tab or free area, defined by the cut portion of the perforation, can be bent perpendicular to the plane of each panel. The uncut hinge lines, in each panel, are placed at different angles to the center line of the panel, as illustrated, whereby each group of four hinge lines, when extended (as shown in broken line in FIG. 12), form a rhombus or equilateral parallelogram. The panels 1 and 2 range in thickness from 0.005 to 0.250 inches. The shape of each partial perforation is preferably round or circular, and cut to inscribe at least 180° but not more than 310°.

Figure 2:
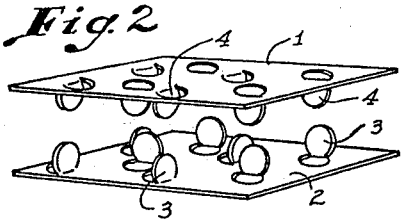
FIG. 2 is a perspective illustration of the two components separated and illustrating the second step in the preparation of the product of this invention.

FIG. 2 illustrates the panels 1 and 2 of FIG. 1 disposed in parallel relation to one another, with their respective tabs 3 and 4 deflected or bent inward about their hinge lines to positions perpendicular to the planes of the panels, and with the tabs being aligned with one another in pairs so that the inner face of each tab 3 is parallel to the plane of the inner face of a corresponding tab 4. As depicted in FIG. 2, the planes of the tabs extending from each panel are angularly disposed to one another, due to the aforementioned angular positioning of their respective hinge lines. The arrangement is such that, considering a group of four tabs extending from the plane of a panel, two of the tabs are in planar facing relation to one another along two opposite sides of a rhombus or parallelogram, and the remaining two tabs in said group are similarly in planar facing relation to one another along the other two opposing sides of said rhombus or parallelogram.

Figure 3:
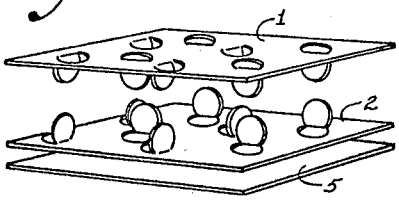
FIG. 3 is a perspective and separated illustration showing the components when a third cover sheet is applied to the product of this invention.

FIG. 3 depicts the panels 1 and 2 in association with a third and unperforated sheet 5 adapted to be adhesively secured to the outer face of panel 2 for the purpose of closing the perforated areas in sheet 2.

Figure 4:
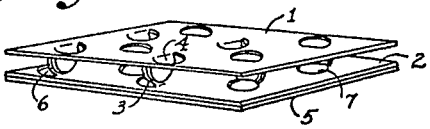
FIG. 4 is a perspective illustration of the assembled configuration of the preferred embodiment of this invention with a single cover sheet.

FIG. 4 illustrates the sheets or panels of FIG. 3 in an assembled configuration. Panels 1 and 2 are joined to one another at their area tabs 3 and 4 respectively with the tab inner faces being adjoined by adhesive 6. Each tab extends substantially completely across the space between the panels 1 and 2, in substantially completely overlapping relation to a tab extending from the other panel. The finishing sheet or panel 5 is bonded to the surface of sheet or panel 2 to close openings 7 from which the area tabs 3 have been extended.

Figure 5:
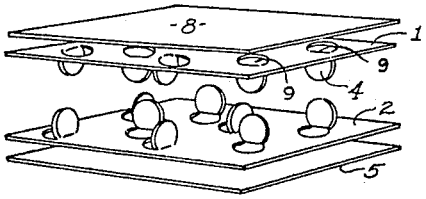
FIG. 5 is a perspective and separated illustration of the components of this invention with two cover sheets.

FIG. 5 is an exploded or separated view of four panels. Panesl 1, 2 and 5 correspond to the elements already described in reference to FIG. 1 through 4. An additional panel 8 is provided for additional coverage and for the purpose of closing openings 9 in panel 1 created by the deflection of area tabs 4 therefrom.

Figure 6:
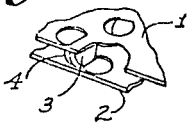
FIG. 6 is an enlarged and cutaway view of an assembled section of the preferred embodiment of this invention.

FIG. 6 is a cutaway view in perspective of panels 1 and 2 showing a single element of assembly; i.e., showing an intermediary link formed by the adjoinment of two corresponding area tabs 3 and 4.

Figure 7:
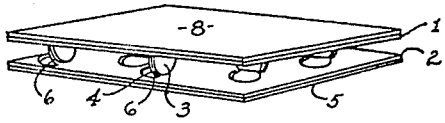
FIG. 7 is a perspective illustration of an assembled section of the preferred embodiment, illustrating the preferred embodiment of this invention showing two cover sheets in place.

FIG. 7 illustrates the completed panel produced by final assembly of the elements described in reference to FIG. 5. Panels 1 and 2 are adjoined by area tabs 3 and 4 that are adhesively bonded together at 6 to retain these panels in their proper relationship one to another. Cover sheets 5 and 8 are added to provide a smooth and finished surface on both planes of the resulting board structure.

Figure 8:
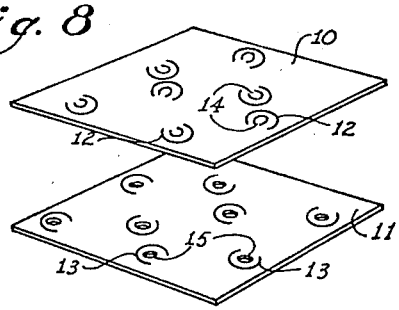
FIG. 8 is a perspective illustration of the components of this invention in a second embodiment.

FIG. 8 illustrates a second embodiment in perspective and separated form. Two panels 10 and 11 have been perforated partially as in FIG. 1, with the perforations 12 and 13 being aligned with one another as earlier described. This second embodiment employs a variation in the perforation arrangement. In this configuration, a full open perforation is placed in the exact center of the partial perforation of one panel. A smaller but identical partial perforation is placed in the area tab of the second panel. The dimension of the partially perforated internal cut made in this tab is 0.005 to 0.010 inch larger than the diameter of full perforation of its opposite member. The two panels are joined by the deflection of the area tabs as done in the preferred embodiment of this invention but an additional step achieves a mechanical coupling of the partial perforation of one tab with the full perforation of the opposite tab, the intent being to eliminate the adhesives associated with the preferred embodiment. More particularly, inside the partially perforated areas 12 in panel 10 are provided second partial perforations 14, which serve to form additional tabs adapted to join fully perforated areas or openings 15 provided in partially perforated tabs 13 of panel 11. The adjoinment of these two elements provide the mechanical interlocking of the area tabs and establishes the thickness of the combined panel pair of achieve the expanded configuration and all of the advantages associated with the preferred embodiment, but without the adhesive requirement.

Figure 9:
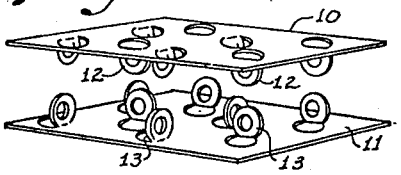
FIG. 9 is a perspective and separated illustration of the components of this invention preparatory to assembly in a second embodiment.

FIG. 9 illustrates the two panels of FIG. 8 preparatory to their adjoinment to one another. The tabs 12 and 13 have been deflected into common planes respectively so that their backs can be aligned when the panels 10 and 11 are moved into finished assembly position.

Figure 10:
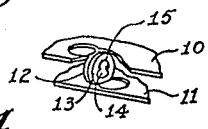
FIG. 10 is a cutaway perspective illustration of a single element of the second embodiment of this invention.

FIG. 10 illustrates an assembled single element or intermediary tab of the panels 10 and 11 of FIGS. 8 and 9 showing the area tabs connected to one another. The tabs 12 and 13 are aligned, and the internal tab 14 of area tab 12 has been forced through the perforation 15 of area tab 13 to achieve an intermediary link or connection retaining panels 10 and 11 mechanically without the use of adhesives.

Figure 11:
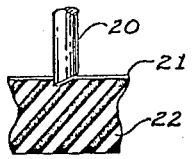
FIG. 11 is a cross-sectional cutaway view illustrating a perforating means to accomplish the partial perforation of the preferred embodiment of this invention.

FIG. 11 is a cross-sectional illustration showing the preferred embodiemt of the perforating means of this invention for producing a partial perforation; i.e., a perforation which leaves an uncut hinge line about which the tab may be deflected. The partial perforation is produced by the lower portions of an angular or contoured face of a pin 20 which is pressed against and through the surface of sheet 21 into a resilient back-up member 22, the latter being rubber or a form of plastic material of hard shore having a resilient memory property. The uppermost end of the angular cutting face is located adjacent the upper surface of sheet 21 when pin 20 assumes the cutting position shown in FIG. 11, to leave the sheet portion adjacent thereto unperforated.

Figure 12:
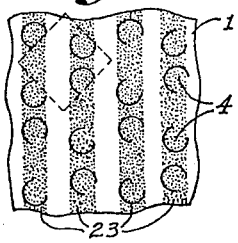
FIG. 12 is a plan view of a partially perforated sheet of the preferred embodiment with a coating of adhesive thereon.

FIG. 12 illustrates a panel of the type already described in reference to FIG. 1, and its partial perforations 4, with adhesive striping or a partial coating of said partial perforations, depicted by the shaded areas 23. It should be noted that the adhesive has been applied prior to deflection of the tabs about their hinge points.

Figure 13:
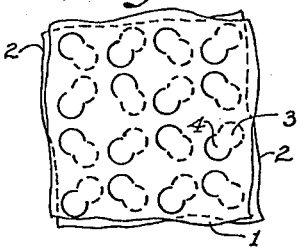
FIG. 13 is a plan view of a sheet perforated as in the preferred embodiment of this invention superimposed over a second sheet, the partial perforations in which are shown in dotted line.

FIG. 13 is a plain illustration of a superimposed pair of sheets of the type shown in FIG. 12. The sheet of FIG. 12 has been rotated 180° so that its top edge, as illustrated in FIG. 12, is the bottom edge as shown in FIG. 13 at 1. It has been overlayed above a second sheet 2 which is also partially perforated and which can be coated with adhesive as in FIG. 12 or which may remain uncoated. The area tabs 4 of panel 1 are shown in dotted line to adjoin tabs 3 of sheet or panel 2 with a space existing between the two sheets so that the adhesive cannot prematurely bond the panels.

Figure 14:
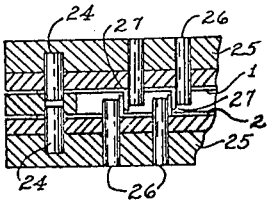
FIG. 14 is a cross-sectional view of a fixture or jig for the assembly of the paper board product of the present invention in panel form.

FIG. 14 is a cross-sectional view of a fixture which makes possible the assembly of the panels of FIG. 12 and 13 following partial perforating and the application of adhesive. The fixture includes a pair of registration pins 24 adapted to properly align a pair of retaining plates 25 which, in turn, hold tab positioning pins 26 operative to deflect the area tabs 27 of panels 1 and 2 about their respective hinge lines. The action of this deflection is such that the tabs are joined in back to back relation with the adhesive therebetween bonding one tab to another.

Figure 15:
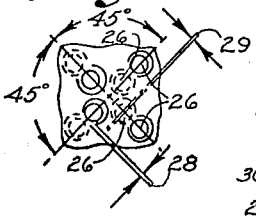
FIG. 15 illustrates the angular relationship of the components of the pin jig.

FIG. 15 is a plan view illustrating the positioning of pins 26 in the fixture of FIG. 14, and the critical spacing in the relationship of these pins to the partial perforations of sheets 1 and 2. The pins achieve deflection of the area tabs and their retention in place adjacent one another during bonding. The pins 26 are smaller in diameter than the partial perforations and pass easily through the perforation openings to deflect the tab so that they are disposed within the space 28 existing between each pair of pins. Space 28 corresponds to the sum of the thickness of the two panels or two tabs. The center line of the pins 26, employed for purpose of deflecting the area tabs, is offset slightly as at 29, relative to the center line of the punch 20, see FIG. 11, previously employed for producing the area tab. This offsetting permits the use of a smaller diameter pin for deflection of the tabs and provide the proper spacing between the pins to hold the tabs in close proximity to one another during bonding. The placement of the pins and tabs in the preferred form of this invention is such that a 45° angle exists between the plane of each tab and the longitudinal direction of the finished board whereby, when the tabs are deflected to form a standing tab structure, groups of four of the tabs each form a box-like structure and present a diamond form extending between the opposing parallel panels of the finished board.

Figure 16:
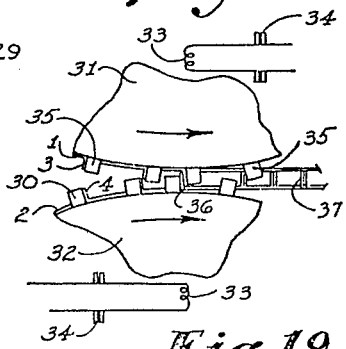
FIG. 16 illustrates a continuous means of assembly employing cylinder units.

FIG. 16 illustrates an apparatus for the assembly of board in accordance with the preferred form of this invention. The assembly apparatus employs two cylinders 31 and 32 which are heated with resistance coils 33, electrical power being transferred to these coils by brushes 34 of the common rotary commutator type. As cylinders 31 and 32 rotate a conjunction of pins 30 and 35, protruding from said cylinders respectively, deflects area tabs 3 and 4 of sheets 1 and 2 and causes them to close together as at 36 forming an intermediary link as shown at 37.

Figure 17:
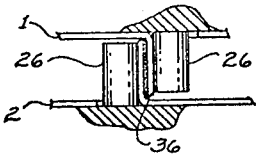
FIG. 17 is a cross-sectional enlarged view of the pins of FIG. 14 illustrating the adjoinment of the area tab components in the preferred embodiment of this invention.

FIG. 17 is representative of the pins 26 of FIG. 14, or of pins 35 and 30 of FIG. 16, and, in an enlarged cutaway view, shows the panels 1 and 2 adjoined with adhesive and held in position at 36 to form an intermediary or structural link in which the area tabs are combined.

Figure 18:
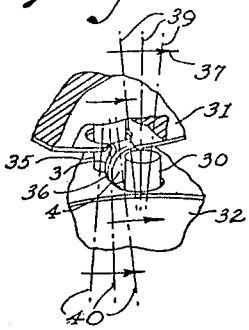
FIG. 18 is an enlarged and partially cutaway perspective illustration showing the adjoinment of the components in the preferred embodiment of this invention and the area tabs positioned with respect to the pins as in FIG. 16.

FIG. 18 further illustrates the rotary closure technique, comprising a preferred embodiment of this invention referred to in reference to FIG. 16. The cylinders 31 and 32 move in the direction of the arrows, causing pins 30 and 35 to substantially meet so as to close area tabs 3 and 4 and accomplish adjoinment 36. During this closure operation, there is a wiping action as pins 30 and 35 move in counter directions as shown by arrow 37, and this movement squeezes excess adhesive from the space between the area tabs, and achieves a secure bonding within the span of angles as shown by the pin center line variations 39 and 40.

Figure 19:
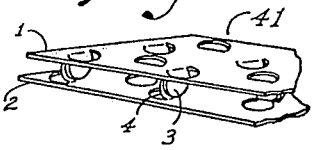
FIG. 19 is a perspective illustration of the assembled components forming the preferred embodiment of this invention.

FIG. 19 is an illustration of panel 1 and 2 as assembled by the process and apparatus of FIG. 14 or FIG. 16, with the resultant product having proper closure of area tabs 3 and 4 to achieve an alignment and completion of board 41.

Figure 20:
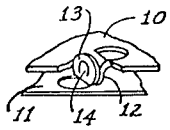
FIG. 20 is a perspective partially cutaway illustration of a single area tab element in a second embodiemtn of this invention in which the two tabs have been placed adjacent to one another but not adjoined.

FIG. 20 is a perspective partially cutaway view of a single element of this invention in accordance with the second embodiment of FIGS. 9 and 10 in which panels 10 and 11 are adjoined to one another by area tabs 12 and 13 with a secondary tab element 14 being forced through a perforation in area tab 12 (not shown).

Figure 21:
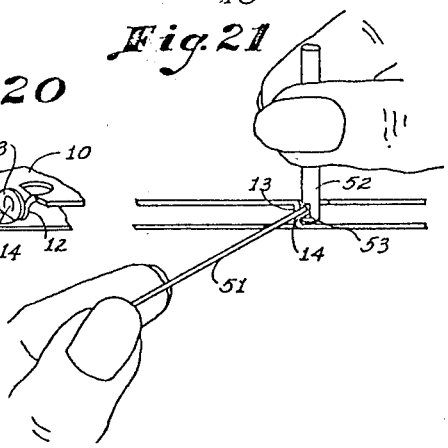
FIG. 21 is a cross-sectional illustration showing the assembly of the secondary embodiment employing hand methods.

FIG. 21 is a cross sectional view of a hand method of closing the components and elements illustrated in FIG. 8, 9, 10 and 20. A hand-held pin 51 is utilized to deflect a secondary area tab 14 through a perforation 15 in each primary area tab 13 after they have been previously hand-positioned relative to one another. The pin 51 cooperates with an anvil-type support provided by a pin 51 held in the opposite hand of the operator and having cut in its surface a suitable relief 53.

Figure 22:
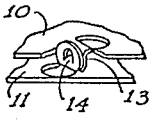
FIG. 22 is a perspective partially cutaway illustration of the finished adjoinment of the area tabs of FIG. 20.

FIG. 22 illustrates a partially cutaway perspective view of the assembled sheets 10 and 11 as assembled by the method of FIG. 21. The secondary area tabs 14 are shown as a single element connection forced through a perforation (not shown) in prime area tab 13.

Changes in the size, shape angularity and arrangement of the partial perforations, and the placement of said partial perforations with respect to the boundaries of the panels utilized can be effected by a person skilled in the art without departing from the spirit and scope of the invention disclosed herein.

FIGS. 23–27, taken together, illustrate a method and apparatus for producing the improved product of the present invention in mass production. FIG. 23 is a schematic plan view of the paper supply portion of the apparatus, comprising two paper stock unwind stations 60 and 61. Paper webs or sheets are drawn from the unwind stations, past guide rolls 62 and 63, by draw roll stations 64 and 65 each of which comprises a two roll set having the web or sheet 66 and 67 passing through the nip of the roll so as to be drawn off the unwinds 60 and 61 in the direction indicated by arrow 68.

FIG. 24 is a plan schematic illustration of the partial perforation portion of the apparatus. Webs 66 and 67 pass through a dual perforating station, in the direction of arrow 68. Web 66 is partially perforated by the uppper perforating station, comprising a plurality of pins 72 extending from the surface of a roller 70 and working in contact with the face of a rubber covered cylinder 71. As the cutting faces of pins 72 cut partial perforations in sheet 66, gearing 72*a* and 73 transfers the motion of rolls 70 and 71 to rolls 74 and 75, a second set of rubber and pin rolls which, working together, act as a lower perforating station which produces a partially perforated hole pattern in web 67 to match that of web 66.

FIG. 25 is a schematic illustration of the next successive portion of the method and apparatus, adapted to apply adhesive to the partially perforated sheets. Webs 66 and 67 move in the direction of arrow 68 past a single bead application adhesive coating station in which a series of discs of identical diameter forming a cylinder assembly 81 which rotates in an adhesive bath 87. The discs are doctored by doctor plate assembly 83 to meter to the surface of web 66 striped amounts of adhesive for adjoinment to web 67, both of which pass through guide roll stations 84 and 85.

FIG. 26 shows, in partial cross-section, the cylinder assembly 81 and the discs 86 mounted on said cylinder and immersed in adhesive fluid 87 retained by reservoir 88 to stripe perforated web 66 travelling in the direction of arrow 89.

FIG. 27 is a schematic view of the next portion of the assembly apparatus and method. A pair of gauging rolls (not shown) acts as lead and guide rolls for two cylinders 92 and 93 that close, in cynchronization, a nip containing a pattern of pins coinciding with the partial perforations in webs 66 and 67. As previously described, closure of said pins produces a bending and adjoinment of the tabs or areas of the partial perforations, with retention in this adjoinment being accomplished by the adhesive application previously made as in FIGS. 25 and 26. A downstream drying means is provided wherein forced air, passing over resistance coils 94, moves in the direction of arrows 95 to fill plenums 96 and is directed through orifices 97 to impinge upon webs 66 and 67. The air exhausts from these plenums as shown at arrow 98, and thus removes residual moisture associated with the adhesive application. The perforated configuration of the board achieves maximum efficiency in the drying zone since, during the drying operation, air readily passes through the perforations in the board faces, past the joined tabs, and out of the edges of the board structure.

FIG. 28 illustrates a completed board section in perspective and representative of the product produced by the method, and apparatus of FIGS. 23–27, showing the combination of panels 1 and 2 utilizing a series of intermediary links. The thickness of the completed board is at least five times as thick as the sum of the thickness of the panels 1 and 2.

It is not necessary that the tab or assembly element of this invention be restricted to utilization of a partial perforation in round form, as depicted in FIGS. 1 et seq. Other embodiments of this invention can employ variations of shapes. For example, the length of the perforated area or tab can be extended beyond the perpendicular bonding area of adjoinment with its opposite member and can be sufficiently long to attach to the inside plane surface of the opposite panel. In addition, the tab shape can be related to some external latching procedure and, for this reason, an irregularity in the tab contour may be desirable.

I claim:

1. An apparatus for joining a pair of sheets comprising perforating means for cutting patterns of plural partial perforations in said sheets respectively, each partial perforation defining a tab area located substantially in the plane of said sheet and adapted to be bent out of the plane of said sheet about the unperforated portion of each partial perforation acting as a hinge line; means for applying an adhesive material to at least one of said sheets; means for transporting said partially perforated sheets in spaced relation to one another with the pattern of partial perforations in each sheet being in opposed relation to the pattern of partial perforations in the other of said sheets; and means for bending the tab areas defined by the partial perforations in said sheets through an angle of substantially 90° to the plane of each sheet in a direction extending toward the other of said sheets to cause corresponding pairs of said tabs extending from said two sheets respectively to come into overlapping, planar engagement with one another in the region between said spaced sheets and to be bonded to one another by said adhesive material.

2. The apparatus of claim 1 wherein said partially perforated sheets form a panel structure, when said overlapping pairs of tabs have been bonded to one another, said means for bonding the tab areas comprising two rotary cylinders disposed in adjacent spaced relation to one another, each of said cylinders having its peripheral area studded with pins standing perpendicular to the cylinder axis and adapted to enter the partial perforations in said pair of sheets respectively, said transporting means being operable to transport said pair of partially perforated sheets in spaced relation to one another into the region between said cylinders, said cylinders being mounted for rotation on parallel axes, the space between said cylinders being such that the nip of the cylinder peripheral areas provides a gap equivalent to the thickness of the panel structure being formed, the pins extending from said cylinders being positioned to pass one another respectively in pairs in said space with a clearance between the pins sides of each pair equivalent to twice the thickness of the sheets being joined, whereby each pair of pins, upon entering partial perforations in said two sheets respectively, bends the partially perforated sheet regions to produce tabs which are deflected perpendicularly from the planes of said sheets into overlapping relation with one another, and the subsequent scissors-like sweeping action of the pins in said space produces a counter directional pin motion which wipes the side surfaces of each overlapping pair of tabs while retaining said pair of tabs together and holding the partial perforations of said sheets in registry with one another.

3. The apparatus of claim 2 wherein said perforating means comprises a pair of rollers mounted for rotation adjacent one another, one of said rollers having a plurality of pins extending from the surface thereof, and the other of said rollers having a resilient surface positioned for engagement with the free ends of said pins at the nip of said rollers.

4. The apparatus of claim 3 wherein said pins are round in cross section.

5. The apparatus of claim 2 wherein said means for bending the tab areas comprises a pair of rollers mounted for counter rotation relative to one another, each of said rollers including a plurality of pins extending from the surface thereof, the pins in said rollers being so positioned relative to one another that, during rotation of said rollers, each pin extending from one of said rollers passes closely adjacent to a pin extending from the other of said rollers at the nip of said rollers.

6. The apparatus of claim 2 including means for drying said joined sheets.

7. The apparatus of claim 6 wherein said drying means comprises means for effecting a forced flow of air past said pairs of tabs via the perforations in at least one of said sheets.

8. The apparatus of claim 2 including means for heating said adhesive material to facilitate bonding of said corresponding pairs of overlapping tabs to one another.

9. The apparatus of claim 2 including means for chilling said adhesive material to facilitate bonding of said corresponding pair of overlapping tabs to one another.

10. The apparatus of claim 2 wherein said means for applying adhesive material comprises means operative to apply said adhesive material in a plurality of parallel stripes.

11. The apparatus of claim 2 wherein said perforating apparatus includes means operative to cut each of said partial perforations in a substantially round arc extending through an angle of at least 180° and not more than 310°.

12. The apparatus of claim 2 wherein said adhesive applying means is located between said perforating means and said bending means.

13. The apparatus of claim 2 wherein said adhesive applying means including means operative to apply adhesive to restricted areas of at least one of said sheets corresponding substantially to said tab areas of said sheet.

* * * * *